US009771549B2

(12) United States Patent
Agarkhed et al.

(10) Patent No.: US 9,771,549 B2
(45) **Date of Patent: *Sep. 26, 2017**

(54) CLEANSING COMPOSITION CONTAINING OLIGODYNAMIC METAL AND EFFICACY ENHANCING AGENT

(71) Applicant: Conopco, Inc., Englewood Cliffs, NJ (US)

(72) Inventors: Ajit Manohar Agarkhed, Maharastra (IN); Nitish Kumar, Bihar (IN); Divya Paruchuri, Hyderabad (IN)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/114,102

(22) PCT Filed: Jan. 6, 2015

(86) PCT No.: PCT/EP2015/050079

§ 371 (c)(1),
(2) Date: Jul. 26, 2016

(87) PCT Pub. No.: WO2015/113782

PCT Pub. Date: Aug. 6, 2015

(65) Prior Publication Data

US 2016/0362646 A1 Dec. 15, 2016

(30) Foreign Application Priority Data

Jan. 29, 2014 (EP) ..... 14152967

(51) Int. Cl.

| | |
|---|---|
| ***C11D 9/18*** | (2006.01) |
| ***C11D 3/12*** | (2006.01) |
| ***C11D 3/33*** | (2006.01) |
| ***C11D 3/37*** | (2006.01) |
| ***C11D 3/48*** | (2006.01) |
| ***C11D 9/10*** | (2006.01) |
| ***C11D 9/22*** | (2006.01) |
| ***C11D 10/04*** | (2006.01) |
| ***C11D 9/00*** | (2006.01) |
| ***C11D 9/02*** | (2006.01) |
| ***C11D 9/30*** | (2006.01) |

(52) U.S. Cl.

CPC ..... *C11D 9/18* (2013.01); *C11D 3/1206* (2013.01); *C11D 3/1213* (2013.01); *C11D 3/33* (2013.01); *C11D 3/3753* (2013.01); *C11D 3/3757* (2013.01); *C11D 3/3776* (2013.01); *C11D 3/48* (2013.01); *C11D 9/007* (2013.01); *C11D 9/02* (2013.01); *C11D 9/10* (2013.01); *C11D 9/225* (2013.01); *C11D 9/30* (2013.01); *C11D 10/04* (2013.01); *C11D 10/042* (2013.01)

(58) Field of Classification Search
None
See application file for complete search history.

(56) References Cited

U.S. PATENT DOCUMENTS

| | | | | |
|---|---|---|---|---|
| 3,050,467 | A | 8/1962 | Horowtiz et al. | |
| 4,477,438 | A | 10/1984 | Willcockson et al. | |
| 4,680,131 | A | 7/1987 | Busch et al. | |
| 4,988,453 | A | 1/1991 | Chambers et al. | |
| 6,730,643 | B2 | 5/2004 | Chokappa et al. | |
| 2006/0240122 | A1 | 10/2006 | Miner et al. | |
| 2007/0179079 | A1* | 8/2007 | Kilkenny | C11D 1/62 510/499 |
| 2010/0143494 | A1 | 6/2010 | Scheuing et al. | |
| 2011/0224120 | A1* | 9/2011 | Meine | C11D 1/04 510/337 |
| 2012/0034314 | A1 | 2/2012 | Levison et al. | |
| 2013/0102515 | A1 | 4/2013 | Hueffer et al. | |

FOREIGN PATENT DOCUMENTS

| | | |
|---|---|---|
| DE | 102009005791 | 1/2009 |
| EP | 0556957 | 8/1993 |
| EP | 2202289 | 6/2010 |
| WO | WO2004028461 | 4/2004 |
| WO | WO2010084057 | 7/2010 |
| WO | W02011131422 | 10/2011 |

OTHER PUBLICATIONS

Search Report EP14152965, Jun. 4, 2014.
Written Opinion EP14152965, Jun. 4, 2014.
Surfactants, BASF SE, 2013, pp. 1-15; XP002737878; p. 2—line corresponding to the product Dehydol TL7.
Search Report in EP14152966, Jul. 9, 2014, pp. 1-2, EP.
Search Report in EP14152967, Jul. 7, 2014, pp. 1-2, EP.
Search Report in PCTEP2015050079, Mar. 31, 2015.
Search Report in PCTEP2015050107, May 4, 2015.
Search Report in PCTEP2015051446, Apr. 15, 2015.
Written Opinion in EP14152966, Jul. 21, 2014, EP.
Written Opinion in EP14152967, Jul. 21, 2014, pp. 1-2, EP.
Written Opinion in PCTEP2015050079, Mar. 31, 2015.
Written Opinion in PCTEP2015050107, May 4, 2015.
Written Opinion in PCTEP2015051446, Apr. 15, 2015.

* cited by examiner

*Primary Examiner* — Necholus Ogden, Jr.
(74) *Attorney, Agent, or Firm* — Ronald A. Koatz

(57) ABSTRACT

In one aspect is disclosed a cleansing composition comprising: (i) a surfactant; (ii) an oligodynamic metal or ions thereof; (iii) a chelating agent; and, a polymer having a group comprising a site having one or more lone pair of electrons wherein, said surfactant is soap. The polymer having a group comprising a site having one or more lone pair of electrons enhances the antimicrobial efficacy of the oligodynamic metal.

5 Claims, No Drawings

CLEANSING COMPOSITION CONTAINING OLIGODYNAMIC METAL AND EFFICACY ENHANCING AGENT

FIELD OF THE INVENTION

The invention relates to the field of antimicrobial compositions containing oligodynamic metal, particularly silver. In particular, it relates to antimicrobial soap bars.

BACKGROUND OF THE INVENTION

Global demand for antimicrobial cleansing compositions is on the rise. Antimicrobial soap bars and cleansers for hand and body are increasingly being preferred by consumers.

Antimicrobial cleansing compositions containing an oligodynamic metal like silver, copper or zinc are very effective against a variety of bacteria. Silver is used most widely. However some metals, especially silver, are particularly prone to destabilisation when exposed to high pH, heat and strong sunlight which cause darkening or agglomeration or under extreme conditions, even phase separation.

Usually such metals are included at ppm or ppb (parts per million/parts per billion) levels which make it imperative to preserve their activity.

WO2007054227 A1 (Lanxess Deutschland GmbH) discloses silver containing macroporous chelating ion exchange resin comprising a copolymer of a monovinyl monomer like styrene and an aromatic divinyl monomer such as divinylbenzene. The copolymer is functionalized with aminoalkylphosphonic groups or with iminodiacetic acid groups. It lends storage stability and delivery to silver.

A journal article entitled "Synthesis of nanosized silver particles by chemical reduction method" [Materials Chemistry and Physics 64 (2000) 241-246] discloses that PVP and PVA are protective agents for silver colloids from agglomeration and they can be used during manufacture of nano silver. PVP is said to prolong the stability.

US2006240122 A1 (Miner Edwin) discloses that polypectate and EDTA can be used to stabilise silver and prolong its antimicrobial effect. It is also disclosed that chelated silver disperses better than non-chelated silver. The polypectate chelates with calcium and magnesium ions. The silver complex is prepared by first forming an ammoniacal silver nitrate mixture. The application also discloses a liquid antiseptic having water, silver ions, polypectate and EDTA.

In KR20070059786A (Bioplus Co Ltd) is disclosed a composition for disinfecting teat of an animal. The composition includes silver nanoparticles and a polymer stabilizer such as polyvinylpyrrolidone, (1-vinyl pyrrolidone)-acrylic acid copolymer, polyoxyethylene stearate and (1-vinylpyrrolidone)-vinyl acetate copolymer.

US4680131 (BUSCH ALFRED [BE] ET AL) discloses Laundry detergent compositions comprising from about 2% to about 60% of organic surfactant, from about 1% to about 20% of smectite-type clay selected from saponites, hectorites and sodium and calcium montmorillonites, from about 0.001 to about 0.4 mmoles % of copper precomplexed with an aminopolycarboxylate sequestrant, and from about 0.5% to about 50% of peroxygen bleaching agent and/or peroxygen bleach percursor therefor. The compositions provide improved bleaching activity.

US2013/102515 (HUEFFER STEPHAN [DE] ET AL) discloses formulations comprising (A) at least one compound selected from aminocarboxylates and olyaminocarboxylates, and salts and derivatives thereof, (B) at least one zinc salt, and (C) at least one homopolymer or copolymer of ethyleneimine.

There still remains an unmet need for faster-acting and efficacious antimicrobial products.

SUMMARY OF THE INVENTION

We have now determined that a polymer having a group comprising a site having one or more lone pair of electrons enhances the antimicrobial efficacy of an oligodynamic metal.

Thus in accordance with a first aspect is disclosed a cleansing composition comprising:

(i) a surfactant;

(ii) an oligodynamic metal;

(iii) a chelating agent; and, a polymer having a group comprising a site having one or more lone pair of electrons; wherein, said surfactant is soap.

In accordance with a second aspect is disclosed use of a polymer having a group comprising a site having one or more lone pair of electrons for enhancing antimicrobial efficacy of an oligodynamic metal in a cleansing composition.

The invention will now be explained in detail.

DETAILED DESCRIPTION OF THE INVENTION

The disclosed cleansing composition includes:

(i) a surfactant;

(ii) an oligodynamic metal;

(iii) a chelating agent; and, a polymer having a group comprising a site having one or more lone pair of electrons; wherein, said surfactant is soap.

Silver, zinc, copper and such other oligodynamic metals are widely used in antimicrobial cleansing compositions. However, their oxides and some salts, especially that of Silver, are sensitive to pH, heat and light. Under such conditions, the active metal tends to discolour to form brown, gray or black particles. The particles are prone to settling and/or agglomeration. Silver-based antimicrobial agents have very good antimicrobial effect. However the efficacy of such oligodynamic metals often tends to gradually dimish over a period of time, especially in the alkaline environment of a cleansing composition.

It has been determined that that antimicrobial efficacy of an oligodynamic metal can be significantly enhanced by a polymer having a group comprising a site having one or more lone pair of electrons.

The Cleansing Composition

The cleansing composition can be in any known format which may further be solid, liquid or gel type. These include handwash liquids, bodywash liquids, soap bars, hand-sanitizers, shower gels, shampoo, floor cleansers and hard surface cleaning compositions.

Surfactant

The cleansing composition contains a base of one or more surfactants to provide the basic cleansing action. The surfactant may be of any class such as anionic, cationic, non-ionic, amphoteric or zwitterionic and it can be chosen according to the end use. Anionic surfactants are the most preferred as they provide good cleansing action and they are often used in variety of cleansing compositions.

The anionic surfactants may be soap-based ones which are sodium/potassium salts of long chain fatty acids.

Preferred embodiments of cleansing composition contain 5 to 85 wt % surfactant, more preferably 10 to 70 wt %, still more preferably 12 to 50 wt %. The type and total surfactant content will depend on the intended purpose of the composition, for example, where the composition is bar of soap then it will predominately contain fatty acid soaps. Where is a mild cleansing bar, it will predominately contain fatty acyl isethionate surfactant. Similarly a shampoo will contain a major portion of sodium alkyl sulphate, or sodium alkyl ether sulphate. A shower gel usually contains sodium lauryl ether sulphate and a betaine.

Usually the composition will contain a mixture of different types of surfactants.

The anionic surfactant may be, for example, an aliphatic sulfonate, such as a primary alkane (e.g. C8-C22) sulfonate, primary alkane (e.g., C8-C22) disulfonate, C8-C22 alkene sulfonate, C8-C22 hydroxyalkane sulfonate or alkyl glyceryl ether sulfonate (AGS); or an aromatic sulfonate such as alkyl benzene sulfonate. Alpha olefin sulfonates are also suitable as anionic surfactants. The anionic may also be an alkyl sulfate (e.g., C12-C18 alkyl sulfate), especially a primary alcohol sulfate or an alkyl ether sulfate (including alkyl glyceryl ether sulfates). The anionic surfactant can also be a sulfonated fatty acid such as alpha sulfonated tallow fatty acid, a sulfonated fatty acid ester such as alpha sulfonated methyl tallowate or mixtures thereof. The anionic surfactant may also be alkyl sulfosuccinates (including mono- and dialkyl, e.g., C6-C22 sulfosuccinates); alkyl and acyl taurates, alkyl and acyl sarcosinates, sulfoacetates, C8-C22 alkyl phosphates and phosphates, alkyl phosphate esters and alkoxyl alkyl phosphate esters, acyl lactates or lactylates, C8-C2, monoalkyl succinates and maleates, sulphoacetates, and acyl isethionates. Another class of anionic surfactants is C8 to C20 alkyl ethoxy (1 to 20 EO) carboxylates. Yet another suitable class of anionic surfactant is C8-C18 acyl isethionates. These esters are prepared by reacting alkali metal isethionates with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms. The acyl isethionate may also be alkoxylated isethionates. The alkyl ether sulphates, alkyl ether sulphosuccinates, alkyl ether phosphates and alkyl ether carboxylic acids and salts thereof may contain from 1 to 20 ethylene oxide or propylene oxide units per molecule Typical anionic cleansing surfactants for use in shampoo compositions include sodium oleyl succinate, ammonium lauryl sulphosuccinate, sodium lauryl sulphate, sodium lauryl ether sulphate, sodium lauryl ether sulphosuccinate, ammonium lauryl sulphate, ammonium lauryl ether sulphate, sodium dodecylbenzene sulphonate, triethanolamine dodecylbenzene sulphonate, sodium cocoyl isethionate, sodium lauryl isethionate, lauryl ether carboxylic acid and sodium N-lauryl sarcosinate. Preferred, in the case of shampoo, are anionic cleansing surfactants are sodium lauryl sulphate, sodium lauryl ether sulphate (n)EO, (where n is from 1 to 3), sodium lauryl ether sulphosuccinate(n)EO, (where n is from 1 to 3), ammonium lauryl sulphate, ammonium lauryl ether sulphate(n)EO, (where n is from 1 to 3), sodium cocoyl isethionate and lauryl ether carboxylic acid (n) EO (where n is from 10 to 20). Mixtures of any of the foregoing anionic cleansing surfactants may also be suitable.

The total amount of anionic cleansing surfactant in shampoo compositions generally ranges from 0.5 to 45 wt %, preferably from 1.5 to 35 wt %, more preferably from 5 to 20 wt % by total weight anionic cleansing surfactant based on the total weight of the composition.

Where the cleansing composition is a liquid and is based on fatty acyl isethionate surfactants, the content thereof is preferably in the range of 1 to 30 wt %, preferably 3 to 25 wt % of the liquid composition. The preferred level depends on the total amount of fatty acyl isethionates surfactants and other synthetic co-surfactants in the cleansing composition. The amount used should comprise of 20 to 90 wt %, preferably 40 to 80 wt % of this total amount of combined fatty acyl isethionates surfactant, and the balance could be synthetic co-surfactants.

A particularly preferred format for compositions of the present invention is a soap bar and liquid soaps. Bars are generally meant for bodywash while liquid soaps can be used for bodywash as well as handwash.

These formats contain a major proportion of fatty acid soap as the anionic surfactant.

The term "fatty acid soap" or, more simply, "soap" is used here in its popular sense. Reference to fatty acid soaps is to the fatty acid in neutralized form. Preferably the fatty acid from which the soap is derived is substantially completely neutralized in forming the fatty acid soap, that is say at least 95%, more particularly at least 98%, of the fatty acid groups thereof have been neutralized. The term "soap" is used herein to mean an alkali metal or alkanol ammonium salts of aliphatic, alkane-, or alkene monocarboxylic acids usually derived from natural triglycerides. Sodium, potassium, magnesium, mono-, di- and tri-ethanol ammonium cations, or combinations thereof, are the most suitable.

Usually a blend of fatty acids is used from which blend of fatty acid soaps is prepared. The term "soap" refers to Sodium, Potassium, Magnesium, mono-, di- and tri-ethanol ammonium cation or combinations thereof. In general, Sodium soaps are used in the compositions of this invention, but up to 15% of the soap content may be some other soap forms such as Potassium, Magnesium or triethanolamine soaps.

Soaps having the fatty acid distribution of coconut oil and palm kernel oil may provide the lower end of the broad molecular weight range. Those soaps having the fatty acid distribution of peanut or rapeseed oil, or their hydrogenated derivatives, may provide the upper end of the broad molecular weight range. It is preferred to use soaps having the fatty acid distribution of coconut oil or tallow, or mixtures thereof, since these are among the more readily available triglyceride fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principle chain lengths are C16 and higher.

Preferred soap for use in the compositions of this invention has at least about 85% fatty acids having about 12 to 18 carbon atoms. The preferred soaps for use in the present invention should include at least about 30% saturated soaps, i.e., soaps derived from saturated fatty acids, preferably at least about 40%, more preferably about 50%, saturated soaps by weight of the fatty acid soap. Soaps can be classified into three broad categories which differ in the chainlength of the hydrocarbon chain, i.e., the chainlength of the fatty acid, and whether the fatty acid is saturated or unsaturated. For purposes of the present invention these classifications are: "Laurics" soaps which encompass soaps which are derived predominantly from C12 to C14 saturated fatty acid, i.e. lauric and myristic acid, but can contain minor amounts of soaps derived from shorter chain fatty acids, e.g., C10. Laurics soaps are generally derived in practice from the hydrolysis of nut oils such as coconut oil and palm kernel oil "Stearics" soaps which encompass soaps which are derived predominantly from C16 to C18 saturated fatty acid, i.e. palmitic and stearic acid but can contain minor level of saturated soaps derived from longer chain fatty acids, e.g., C20. Stearics soaps are generally derived in practice from triglyceride oils such as tallow, palm oil and palm stearin.

"Oleics" soaps which encompass soaps which are derived from unsaturated fatty acids including predominantly oleic acid (C18:1), linoeleic acid((C18:2), myristoleic acid (C14:1) and palmitoleic acid (C16:1) as well as minor amounts of longer and shorter chain unsaturated and polyunsaturated fatty acids. Oleics soaps are generally derived in practice from the hydrolysis of various triglyceride oils and fats such as tallow, palm oil, sunflower seed oil and soybean oil. Coconut oil employed for the soap may be substituted in whole or in part by other "high-laurics" or "laurics rich" oils, that is, oils or fats wherein at least 45% of the total fatty acids are composed of lauric acid, myristic acid and mixtures thereof. These oils are generally exemplified by the tropical nut oils of the coconut oil class. For instance, they include: palm kernel oil, babassu oil, ouricuri oil, tucum oil, cohune nut oil, murumuru oil, jaboty kernel oil, khakan kernel oil, dika nut oil, and ucuhuba butter.

It is preferable to keep the level of unsaturated soap to minimum.

Soap may be made by the classic kettle boiling process or modern continuous soap manufacturing processes wherein natural fats and oils such as tallow, palm oil or coconut oil or their equivalents are saponified with an alkali metal hydroxide using procedures well known to those skilled in the art. Two broad processes are of particular commercial importance. The SAGE process where triglycerides are saponified with a base, e.g., sodium hydroxide, and the reaction products extensively treated and the glycerin component extracted and recovered. The second process is the SWING process, where the saponification product is directly used with less exhaustive treatment and the glycerin from the triglyceride is not separated but rather included in the finished soap noodles and/or bars. Alternatively, the soaps may be made by neutralizing fatty acids (e.g., distilled fatty acids), such as lauric (C12), myristic (C14), palmitic (C16), stearic (C18) and oleic acid (C18:1) acids and their mixtures with an alkali metal hydroxide or carbonate.

Where amphoteric surfactants are used, it is preferred that such surfactants include at least one acid group. This may be a carboxylic or a sulphonic acid group. They include quaternary nitrogen and therefore are quaternary amido acids. They should generally include an alkyl or alkenyl group of 7 to 18 carbon atoms. Suitable amphoteric surfactants include amphoacetates, alkyl and alkyl amido betaines, and alkyl and alkyl amido sulphobetaines. Amphoacetates and diamphoacetates are also intended to be covered in possible zwitterionic and/or amphoteric compounds which may be used.

Zwitterionic surfactants may also be present in some compositions of this invention. Zwitterionic surfactants suitable for use herein include, but are not limited to derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one substituent contains an anionic group, e.g., carboxy, sulfonate, sulfate, phosphate, or phosphonate. Illustrative zwitterionics are coco dimethyl carboxymethyl betaine, cocoamidopropyl betaine, cocobetaine, oleyl betaine, cetyl dimethyl carboxymethyl betaine, lauryl bis-(2-hydroxyethyl) carboxymethyl betaine, stearyl bis-(2-hydroxypropyl) carboxymethyl betaine, oleyl dimethyl gamma-carboxypropyl betaine, lauryl bis-(2-hydroxpropyl)alpha-carboxyethyl betaine, and mixtures thereof. The sulfobetaines may include stearyl dimethyl sulfopropyl betaine, lauryl dimethyl sulfoethyl betaine, lauryl bis-(2-hydroxyethyl) sulfopropyl betaine and mixtures thereof.

The amount of zwitterionic surfactant depends on the amount of other surfactants and also the nature and format of the cleansing compositions.

Suitable nonionic surfactants include the reaction products of compounds having a hydrophobic group and a reactive hydrogen atom, for example aliphatic alcohols or fatty acids, with alkylene oxides, especially ethylene oxide either alone or with propylene oxide. Examples include the condensation products of aliphatic (C8-C18) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides. The nonionic may also be a sugar amide, such as alkyl polysaccharides and alkyl polysaccharide amides.

Examples of some cationic surfactants which may be used are the quaternary ammonium compounds such as alkyldimethylammonium halides.

Detailed account of other surfactants which may be used can be found in "Surface Active Agents and Detergents" (Vol. I & II) by Schwartz, Perry & Berch.

The Oligodynamic Metal

The cleansing composition contains a metal having oligodynamic activity. It (also called as oligodynamic action) is the effect of inhibiting, or killing micro-organisms by the use of very small amounts of a chemical substance. Several metals exhibit such an effect. Preferred metals are silver, copper, zinc or gold. Silver is particularly preferred. In the ionic form it may exist as a salt or any compound in any applicable oxidation state.

Preferred embodiments of the cleansing composition have 0.00001 to 5 wt % metal. Where the metal is present in the form of a compound such as Silver in the form of Silver acetate; then an appropriate amount of the compound is included so that the active metal content is within the broad and preferred ranges as already indicated. The compound is present in the composition at a level equivalent to metal content of 0.00001 to 5 wt % at the broadest level as disclosed earlier. Preferred embodiments have 0.0001 to 2 wt % metal content.

Silver (I) Compound

A preferred embodiment of the cleansing composition contains silver as the oligodynamic metal. Silver is usually included in the form of Silver(I) compound but may also be in the form of particles, eg., nanoparticles.

Silver(I) compounds are one or more water-soluble silver (I) compounds having silver ion solubility at least $1.0\times10^{-4}$ mol/L (in water at 25° C.). Silver ion solubility, as referred to herein, is a value derived from a solubility product (Ksp) in water at 25° C., a well known parameter that is reported in numerous sources. More particularly, silver ion solubility [Ag+], a value given in mol/L may be calculated using the formula:

$$[Ag+]=(Ksp\cdot x)^{(1/(x+1))},$$

wherein Ksp is the solubility product of the compound of interest in water at 25° C., and x represents the number of moles of silver ion per mole of compound. It has been found that Silver(I) compounds having a silver ion solubility of at least $1\times10^{-4}$ mol/L in are suitable for use herein. Silver ion solubility values for a variety of silver compounds are given in Table 1:

TABLE 1

| Silver Compound | X | Ksp (mol/L in water at 25° C.) | Silver Ion Solubility [Ag+] (mol/L in water at 25° C.). |
|---|---|---|---|
| silver nitrate | 1 | 51.6 | 7.2 |
| Silver acetate | 1 | 2.0 × 10−3 | 4.5 × 10−2 |
| Silver sulfate | 2 | 1.4 × 10−5 | 3.0 × 10−2 |
| Silver benzoate | 1 | 2.5 × 10−5 | 5.0 × 10−3 |
| Silver salicylate | 1 | 1.5 × 10−5 | 3.9 × 10−3 |
| Silver carbonate | 2 | 8.5 × 10−12 | 2.6 × 10−4 |
| Silver citrate | 3 | 2.5 × 10−16 | 1.7 × 10−4 |
| Silver oxide | 1 | 2.1 × 10−8 | 1.4 × 10−4 |
| Silver phosphate | 3 | 8.9 × 10−17 | 1.3 × 10−4 |
| Silver chloride | 1 | 1.8 × 10−10 | 1.3 × 10−5 |
| Silver bromide | 1 | 5.3 × 10−13 | 7.3 × 10−7 |
| Silver iodide | 1 | 8.3 × 10−17 | 9.1 × 10−9 |
| Silver sulfide | 2 | 8.0 × 10−51 | 2.5 × 10−17 |

In preferred compositions, silver is present in the form of a compound selected from silver oxide, silver nitrate, silver acetate, silver sulfate, silver benzoate, silver salicylate, silver carbonate, silver citrate or silver phosphate. In particularly preferred compositions the silver(I) compound is silver oxide.

Chelating Agent:

The compositions also contain a chelating agent. Chelates are characterized by coordinate covalent bonds. These occur when unbonded pairs of electrons on non-metal atoms like nitrogen and oxygen fill vacant d-orbitals in the metal atom being chelated. Valence positive charges on the metal atom can be balanced by the negative charges of combining amino acid ligands. The bonding of an electron pair into vacant orbitals of the metal allows for more covalent bonding than the valence (or oxidation number) of the metal would indicate. Forming bonds this way is called coordination chemistry. This allows chelates to form, providing that the ligands can bond with two or more moieties within the same molecule and providing that proper chemistry promoting chelation is present. An important factor is the strength of the complex formed between the metal ion and the chelating agent. This determines whether the complex will be formed in the presence of competing anions. The stability or equilibrium constant (K), expressed as log K, has been determined for many metals and chelating agents. The higher the log K values, the more tightly the metal ion will be bound to the chelating agent and the more likely that the complex will be formed.

Preferred chelating agents are ethylene diamine tetraacetic acid (EDTA), ethylene diamine dissuccinate (EDDS), N,N-bis(carboxymethyl) glutamic acid (GLDA), Diethylenetriaminepentaacetic acid (DTPA), Nitrilotriacetic acid (NTA) and Ethanoldiglycinic acid ((EDG). DTPA is particularly preferred and especially in combination with Silver. Chelating agents are usually used in the form of their salts with a metal. For example, EDTA is used in the form of disodium or tetrasodium salt. Accordingly it is preferred to use a salt form of a chelating agent over the natural acid form. Strong chelating salts are able to sequester and chelate magnesium and calcium ions and heavy metal cations such as iron, manganese, zinc and aluminum. Certain chelant salts such as EDTA are widely used as preservatives in soap bars at very small levels.

The Polymer

The polymer has a group comprising a site having one or more lone pair of electrons. In preferred embodiments of the composition, the polymer is polyvinylpyrrolidone (PVP) or polyvinylacetate or polyvinyl alcohol or a copolymer thereof. Preferred compositions contain 0.001 to 2% wt % of the polymer. More preferred compositions contain 0.002 to 0.1 wt % thereof.

PVP is a polymer whose individual units contain an amide group. It is believed that the N and O atoms of this polar group have strong affinity for the ions, especialy silver, as well as metallic silver. It envelops the ions and nano particulates to significantly reduce agglomeration leading to enhancement of efficacy of the oligodynamic metal.

In preferred embodiment the ratio of the metal to the polymer is in the range of 1:1 to 1:500. Further preferred embodiments have ratio of 1:1 to 1:100, more preferably 1:1 to 1:50.

In further preferred embodiments, the vinylpyrrolidone content in said copolymer is from 10% to 95%.

A particularly preferred polymer is PVP/VA copolymer Luviscol® VA 64 W. It is Vinyl pyrrolidone/Vinyl acetate copolymer in water. The Luviskol® VA grades are polymeric film-forming agents that are used as hair fixatives particularly in aerosol sprays, pump sprays, liquid products, mousses and gels.

Optional and Preferred Ingredients

In addition to the ingredients described earlier, preferred embodiments of the cleansing compositions may also include other optional and preferred ingredients for their known benefits. The type and content will largely depend on the nature and type of cleansing composition as well as general principles of formulation science.

Where the composition is in the form of a bar of soap or a liquid soap, it is preferred that the composition contains free fatty acids. Preferred embodiments contain 0.01 wt % to 10 wt % free fatty acid, especially when major portion of the surfactant is soap based. Potentially suitable fatty acids are C8 to C22 fatty acids. Preferred fatty acids are C12 to C18, preferably predominantly saturated, straight-chain fatty acids. However, some unsaturated fatty acids can also be employed. Of course the free fatty acids can be mixtures of shorter chainlength (e.g., 010 to C14) and longer chainlength (e.g., C16-C18) chain fatty acids. For example, one useful fatty acid is fatty acid derived from high-laurics triglycerides such as coconut oil, palm kernel oil, and babasu oil. The fatty acid can be incorporated directly or they can be generated in-situ by the addition of a protic acid to the soap during processing. Examples of suitable protic acids include: mineral acids such as hydrochloric acid and sulfuric acid, adipic acid, citric acid, glycolic acid, acetic acid, formic acid, fumaric acid, lactic acid, malic acid, maleic acid, succinic acid, tartaric acid and polyacrylic acid. However, care should be taken that the residual electrolyte in the bar does not substantially reduce the effectiveness of the anticracking agent. The level of fatty acid having a chain length of 14 carbon atoms and below should generally not exceed 5.0%, preferably not exceed about 1% and most preferably be 0.8% or less based on the total weight of the continuous phase.

Other optional compositions include one or more skin benefit agents. The term "skin benefit agent" is defined as a substance which softens or improves the elasticity, appearance, and youthfulness of the skin (stratum corneum) by either increasing its water content, adding, or replacing lipids and other skin nutrients; or both, and keeps it soft by retarding the decrease of its water content. Included among the suitable skin benefit agents are emollients, including, for example, hydrophobic emollients, hydrophilic emollients, or blends thereof. Water-soluble skin benefit agents may optionally be formulated into the liquid compositions of the invention. A variety of water-soluble skin benefit agents can be used and the level can be from 0 to 50% but preferably from 1 to 30% by weight of the composition. These materials include, but are not limited to, polyhydroxy alcohols. Preferred water soluble skin benefit agents are glycerin, sorbitol and polyethylene glycol.

Water-insoluble skin benefit agents may also be formulated into the compositions as conditioners and moisturizers. Examples include silicone oils; hydrocarbons such as liquid paraffins, petrolatum, microcrystalline wax, and mineral oil; and vegetable triglycerides such as sunflowerseed and cottonseed oils.

Water soluble/dispersible polymes is an optional ingredient that is highly preferred to be included in composition. These polymers can be cationic, anionic, amphoteric or nonionic types with molecular weights higher than 100,000 Dalton. They are known to increase the viscosity and stability of liquid cleanser compositions, to enhance in-use and after-use skin sensory feels, and to enhance lather creaminess and lather stability.

Amount of the polymers, when present, may range from 0.1 to 10% by weight of the composition.

Examples of water soluble/or dispersible polymers include the carbohydrate gums such as cellulose gum, microcrystalline cellulose, cellulose gel, hydroxyethyl cellulose, hydroxypropyl cellulose, sodium carboxymethylcellulose, methyl cellulose, ethyl cellulose, guar gum, gum karaya, gum tragacanth, gum arabic, gum acacia, gum agar, xanthan gum and mixtures thereof; modified and nonmodified starch granules and pregelatinized cold water soluble starch; emulsion polymers such as Aculyn® 28, Aculyn® 22 or Carbopol® Aqua SF1; cationic polymer such as modified polysaccharides including cationic guar available from Rhone Poulenc under the trade name Jaguar® C13S, Jaguar® C14S, Jaguar® C17, or Jaguar® C16; cationic modified cellulose such as UCARE® Polymer JR 30 or JR 40 from Amerchol; N-Hance® 3000, N-Hance® 3196, N-Hance® GPX 215 or N-Hance® GPX 196 from Hercules; synthetic cationic polymer such as Merquat® 100, Merquat® 280, Merquat® 281 and Merquat® 550 sold by Nalco; cationic starches such as StaLok® 100, 200, 300 and 400 sold by Staley Inc.; cationic galactomannans such as Galactasol® 800 series by Henkel, Inc.; Quadrosoft® LM-200; and Polyquaternium-24®. Also suitable are high molecular weight polyethylene glycols such as Polyox® WSR-205 (PEG 14M), Polyox® WSR-N-60K (PEG 45), and Polyox® WSR-301 (PEG 90M).

Preservatives can also be added into the compositions to protect against the growth of potentially harmful microorganisms. Suitable traditional preservatives for compositions of this invention are alkyl esters of para-hydroxybenzoic acid. Other preservatives which have more recently come into use include hydantoin derivatives, propionate salts, and a variety of quaternary ammonium compounds. Particularly preferred preservatives are phenoxyethanol, methyl paraben, propyl paraben, imidazolidinyl urea, sodium dehydroacetate and benzyl alcohol. The preservatives should be selected having regard for the use of the composition and possible incompatibility between the preservatives and other ingredients. Preservatives are preferably employed in amounts ranging from 0.01% to 2% by weight of the composition.

A variety of other optional materials may be formulated into the compositions. These may include: antimicrobials such as 2-hydroxy-4,2',4'-trichlorodiphenylether (triclosan), 2,6-dimethyl-4-hydroxychlorobenzene, and 3,4,4'-trichlorocarbanilide; scrub and exfoliating particles such as polyethylene and silica or alumina; cooling agents such as menthol; skin calming agents such as aloe vera; and colorants.

In addition, the compositions may further include 0 to 10% by weight of opacifiers and pearlizers such as ethylene glycol distearate, titanium dioxide or Lytron® 621 (Styrene/Acrylate copolymer); all of which are useful in enhancing the appearance or properties of the product.

Soap bars in parrticular may contain particles that are greater than 50 μm in average diameter that help remove dry skin. Not being bound by theory, the degree of exfoliation depends on the size and morphology of the particles. Large and rough particles are usually very harsh and irritating. Very small particles may not serve as effective exfoliants. Such exfoliants used in the art include natural minerals such as silica, talc, calcite, pumice, tricalcium phosphate; seeds such as rice, apricot seeds, etc; crushed shells such as almond and walnut shells; oatmeal; polymers such as polyethylene and polypropylene beads, flower petals and leaves; microcrystalline wax beads; jojoba ester beads, and the like. These exfoliants come in a variety of particle sizes and morphology ranging from micron sized to a few mm. They also have a range of hardness. Some examples are talc, calcite, pumice, walnut shells, dolomite and polyethylene.

Advantageously, active agents other than skin conditioning agents defined above may be added to the composition. These active ingredients may be advantageously selected from bactericides, vitamins, anti-acne actives; anti-wrinkle, anti-skin atrophy and skin repair actives; skin barrier repair actives; non-steroidal cosmetic soothing actives; artificial tanning agents and accelerators; skin lightening actives; sunscreen actives; sebum stimulators; sebum inhibitors; anti-oxidants; protease inhibitors; skin tightening agents; anti-itch ingredients; hair growth inhibitors; 5-alpha reductase inhibitors; desquamating enzyme enhancers; anti-glycation agents; or mixtures thereof; and the like.

These active agents may be selected from water-soluble active agents, oil soluble active agents, pharmaceutically acceptable salts and mixtures thereof. The term "active agent" as used herein, means personal care actives which can be used to deliver a benefit to the skin and/or hair and which generally are not used to confer a skin conditioning benefit, such are delivered by emollients as defined above. The term "safe and effective amount" as used herein, means an amount of active agent high enough to modify the condition to be treated or to deliver the desired skin care benefit, but low enough to avoid serious side effects. The term "benefit," as used herein, means the therapeutic, prophylactic, and/or chronic benefits associated with treating a particular condition with one or more of the active agents described herein. What is a safe and effective amount of the active agent(s) will vary with the specific active agent, the ability of the active to penetrate through the skin, the age, health condition, and skin condition of the user, and other like factors.

A wide variety of active agent ingredients are useful for the inventive personal toilet bar compositions and include those selected from anti-acne actives, anti-wrinkle and anti-skin atrophy actives, skin barrier repair aids, cosmetic soothing aids, topical anesthetics, artificial tanning agents and accelerators, skin lightening actives, antimicrobial and antifungal actives, sunscreen actives, sebum stimulators, sebum inhibitors, anti-glycation actives and mixtures thereof and the like.

Anti-acne actives can be effective in treating acne vulgaris, a chronic disorder of the pilosebaceous follicles. Nonlimiting examples of useful anti-acne actives include the keratolytics such as salicylic acid (o-hydroxybenzoic acid), derivatives of salicylic acid such as 5-octanoyl salicylic acid and 4 methoxysalicylic acid, and resorcinol; retinoids such as retinoic acid and its derivatives (e.g., cis and trans); sulfur-containing D and L amino acids and their derivatives and salts, particularly their N-acetyl derivatives, mixtures thereof and the like.

Skin barrier repair actives are those skin care actives which can help repair and replenish the natural moisture barrier function of the epidermis. Non limiting examples of skin barrier repair actives include lipids such as cholesterol, ceramides, sucrose esters and pseudo-ceramides as described in European Patent Specification No. 556,957; ascorbic acid; biotin; biotin esters; phospholipids, mixtures thereof, and the like.

Artificial tanning actives can help in simulating a natural suntan by increasing melanin in the skin or by producing the appearance of increased melanin in the skin. Nonlimiting examples of artificial tanning agents and accelerators include dihydroxyacetaone; tyrosine; tyrosine esters such as ethyl tyrosinate and glucose tyrosinate; mixtures thereof, and the like.

Skin lightening actives can actually decrease the amount of melanin in the skin or provide such an effect by other mechanisms. Nonlimiting examples of skin lightening actives useful herein include aloe extract, alpha-glyceryl-L-ascorbic acid, aminotyrosine, ammonium lactate, glycolic acid, hydroquinone, 4 hydroxyanisole, mixtures thereof, and the like.

Also useful are sunscreen actives. Nonlimiting examples of sunscreens which are useful in the compositions of the present invention are those selected from the group consisting of octyl methoxyl cinnamate (Parsol MCX) and butyl methoxy benzoylmethane (Parsol 1789), 2-ethylhexyl p-methoxycinnamate, 2-ethylhexyl N,N-dimethyl-p-aminobenzoate, p-aminobenzoic acid, 2-phenylbenzimidazole-5sulfonic acid, oxybenzone, mixtures thereof, and the like.

Also useful are protease inhibitors. Protease inhibitors can be divided into two general classes: the proteinases and the peptidases. Proteinases act on specific interior peptide bonds of proteins and peptidases act on peptide bonds adjacent to a free amino or carboxyl group on the end of a protein and thus cleave the protein from the outside. The protease inhibitors suitable for use in the inventive personal toilet bar compositions include, but are not limited to, proteinases such as serine proteases, metalloproteases, cysteine proteases, and aspartyl protease, and peptidases, such as carboxypepidases, dipeptidases and aminopepidases, mixtures thereof and the like.

Other useful active ingredients are skin tightening agents. Nonlimiting examples of skin tightening agents which are useful in the compositions of the present invention include monomers which can bind a polymer to the skin such as (meth)acrylic acid and a hydrophobic monomer comprised of long chain alkyl (meth)acrylates, mixtures thereof, and the like.

Active ingredients in the inventive personal toilet bar compositions may also include anti-itch ingredients. Suitable examples of anti-itch ingredients which are useful in the compositions of the present invention include hydrocortisone, methdilizine and trimeprazine, mixtures thereof, and the like.

Nonlimiting examples of hair growth inhibitors which are useful in the inventive personal toilet bar compositions include 17 beta estradiol, anti angiogenic steroids, curcuma extract, cycloxygenase inhibitors, evening primrose oil, linoleic acid and the like. Suitable 5-alpha reductase inhibitors such as ethynylestradiol and, genistine mixtures thereof, and the like.

Advantageously cationic skin feel agent(s) or polymer(s) are used from about 0.01, 0.1 or 0.2% by wt. to about 1, 1.5 or 2.0% by wt. in soap bars.

Cationic cellulose is available from Amerchol Corp. (Edison, N.J., USA) in their Polymer JR® and LR® series of polymers, as salts of hydroxyethyl cellulose reacted with trimethyl ammonium substituted epoxide, referred to in the industry (CTFA) as Polyquaternium® 10. Another type of cationic cellulose includes the polymeric quaternary ammonium salts of hydroxyethyl cellulose reacted with lauryl dimethyl ammonium-substituted epoxide, referred to in the industry (CTFA) as Polyquaternium® 24. These materials are available from Amerchol Corp. (Edison, N.J., USA) under the tradename Polymer LM-200®, and quaternary ammonium compounds such as alkyldimethylammonium halogenides.

A particularly suitable type of cationic polysaccharide polymer that can be used is a cationic guar gum derivative, such as guar hydroxypropyltrimonium chloride (Commercially available from Rhone-Poulenc in their JAGUAR® trademark series). Examples are JAGUAR® C135, which has a low degree of substitution of the cationic groups and high viscosity, JAGUAR® C15, having a moderate degree of substitution and a low viscosity, JAGUAR® C17 (high degree of substitution, high viscosity), JAGUAR® C16, which is a hydroxypropylated cationic guar derivative containing a low level of substituent groups as well as cationic quaternary ammonium groups, and JAGUAR® 162 which is a high transparency, medium viscosity guar having a low degree of substitution.

Particularly preferred cationic polymers are JAGUAR® C13S, JAGUAR® C15, JAGUAR® C17 and JAGUAR® C16 and JAGUAR® C162, especially JAGUAR® C13S. Other cationic skin feel agents known in the art may be used provided that they are compatible with the inventive formulation.

Other preferred cationic compounds that are useful in the present invention include amido quaternary ammonium compounds such as quaternary ammonium propionate and lactate salts, and quaternary ammonium hydrolyzates of silk or wheat protein, and the like. Many of these compounds can be obtained as the Mackine® Amido Functional Amines, Mackalene® Amido functional Tertiary Amine Salts, and Mackpro® cationic protein hydrolysates from the McIntyre Group Ltd. (University Park, Ill.).

In embodiments having a hydrolyzed protein conditioning agent, the average molecular weight of the hydrolyzed protein is preferably about 2500. Preferably 90% of the hydrolyzed protein is between a molecular weight of about 1500 to about 3500. In a preferred embodiment, MACKPRO® WWP (i.e. wheat germ amido dimethylamine hydrolyzed wheat protein) is added at a concentration of 0.1% (as is) in the bar.

Manufacture of Bars of Soap

Soap bars/tablets can be prepared using manufacturing techniques described in the literature and known in the art for the manufacture of soap bars. Examples of the types of manufacturing processes available are given in the book Soap Technology for the 1990's (Edited by Luis Spitz, American Oil Chemist Society Champaign, Illinois. 1990). These broadly include: melt forming, extrusion/stamping, and extrusion, tempering, and cutting. A preferred process is extrusion and stamping because of its capability to economically produce high quality bars.

The soap bars may, for example, be prepared by either starting with or forming the soap in situ. When employing the fatty acid or acids that are the precursors of the soap as starting ingredients such acid or acids may be heated to temperature sufficient to melt same and typically at least 80° C. and, more particularly from 80° C. to below 100° C., and neutralized with an suitable neutralizing agent or base, for example, sodium hydroxide, commonly added as a caustic solution. The neutralizing agent is preferably added to the melt in an amount sufficient to fully neutralize the soap-forming fatty acid and, in at least one embodiment, is preferably added in an amount greater than that required to substantially completely neutralize such fatty acid.

Following neutralization, excess water may be evaporated and additional composition components, including silver (I) compound added. Though not necessary, it is preferred that a carrier, preferably talc, glycerin or triethylamine is used to add the Siilver(I) compound. Desirably the water content is reduced to a level such that, based on the total weight thereof, the resulting bars contains no more that 25% by weight, preferably no more than 20% by weight, more preferably no more than 18% by weight of water, with water contents of from 8 to 15% by weight being typical of many bars. In the course of processing, either as part of neutralization and/or subsequent thereto, the pH may be adjusted, as needed, to provide the high pH of at least 9 which is desired for the subject bars.

The resulting mixture may be formed into bars by pouring the mixture, while in a molten state into molds or, by amalgamation, milling, plodding and/or stamping procedures as are well known and commonly employed in the art. In a typical process, the mixture is extruded through a multi-screw assembly and the thick liquid that exits therefrom, which typically has a viscosity in the range of 80,000 to 120,000 cPs, is made to fall on rotating chilled rolls. When the viscous material falls on the chilled rolls, flakes of soap are formed. These flakes are then conveyed to a noodler plate for further processing. As the name suggests, the material emerging from this plate is in the form of noodles. The noodles are milled, plodded and given the characteristic shape of soap bars.

The bars may also be made by a melt cast processes and variations thereof. In such processes, saponification is carried out in an ethanol-water mixture (or the saponified fatty acid is dissolved in boiling ethanol). Following saponification other components may be added, and the mixture is preferably filtered, poured into molds, and cooled. The cast composition then undergoes a maturation step whereby alcohol and water are reduced by evaporation over time. Maturation may be of the cast composition or of smaller billets, bars or other shapes cut from same. In a variation of such process described in U.S. Pat. No. 4,988,453 B1 and U.S. Pat. No. 6,730,643 B1, the saponification is carried out in the presence of polyhydric alcohol and water, with the use of volatile oil in the saponification mixture being reduced or eliminated. Melt casting allows for the production of translucent or transparent bars, in contrast to the opaque bars typically produced by milling or other mechanical techniques.

Antimicrobial Effect

The cleansing compositions disclosed herein have biocidal activity against Gram positive bacteria, including in particular *S. aureus*. Other Gram positive bacteria against which the compositions are of interest are *S. epidermidis*, and/or *Corynebacteria*, in particular, *Corynebacteria* strains responsible for the hydrolysis of axilla secretions to malodorous compounds. Desirably, the bar provides a $\log_{10}$ reduction in biocial activity against *Staphylococcus aureus* ATCC 6538 of at least 2, preferably at least 3 more preferably at least 3.5 at a contact time of 30 seconds, and even more preferably provides a $\log_{10}$ reduction against *S aureus* ATCC 6538 of at least 1, preferably at least 1.5 more preferably at least 2 at a contact time of 10 seconds.

When in use in the form of soap bar, the bar is diluted with water to form a 1 to 25 wt % solution thereof, the resulting soap solution applied to the skin for contact times under 1 minute, typically 30 seconds or less with contact times of 10 to 30 seconds being of interest with respect to contact times of a moderate to relatively long duration and contact times of 10 seconds or less being of interest with respect to contact times of short to moderate duration, and thereafter is removed from the skin, typically by rinsing with water. Preferably the bars have a lather volume of at least 200 ml following the procedure of Indian Standard 13498:1997, Annex C.

Compositions, especially in the form of soap bars are of interest with respect to biocidal activity against Gram positive bacteria, including in particular *S. aureus*. Other Gram positive bacteria against which the soap compositions are of interest are *S. epidermidis*, and/or *Corynebacteria*, in particular, *Corynebacteria* strains responsible for the hydrolysis of axilla secretions to malodorous compounds. Desirably, the bar provides a $\log_{10}$ reduction in biocial activity against *Staphylococcus aureus* ATCC 6538 of at least 2, preferably at least 3 more preferably at least 3.5 at a contact time of 30 seconds, and even more preferably provides a $\text{Log}_{10}$ Reduction against *S aureus* ATCC 6538 of at least 1, preferably at least 1.5 more preferably at least 2 at a contact time of 10 seconds. In use, the bars are diluted with water to form what is typically a 1 to 25 wt % solution thereof in water, the resulting soap solution applied to the skin for contact times under 1 minute, typically 30 seconds or less with contact times of 10 to 30 seconds being of interest with respect to contact times of a moderate to relatively long duration and contact times of 10 seconds or less being of interest with respect to contact times of short to moderate duration, and thereafter is removed from the skin, typically by rinsing with water. Preferably the bars have a lather volume of at least 200 ml following the procedure of Indian Standard 13498: 1997, Annex C, incorporated herein by reference.

EXAMPLES

The following non-limiting examples are provided to further illustrate the invention; the invention is not in any way limited thereto. The protocol described hereinafter was used to evaluate antimicrobial (antibacterial) activity.

In-vitro Time-Kill Protocol

Soap Solution Preparation

The solid soap bar being evaluated is mixed with water and dissolved at 50° C. to give a 10 wt % solution. After dissolution, the resulting soap bar solution is equilibrated at 46° C. prior to performing the bactericidal assay procedure.

Bacteria

*Staphylococcus aureus* ATCC 6538, were used in this study to represent Gram positive bacteria. The bacteria was stored at −80° C. Fresh isolates were cultured twice on Tryptic Soy Agar plates for 24 hours at 37° C. before each experiment.

In-Vitro Time-Kill Assay

Time-kill assays are performed according to the European Standard, EN 1040:2005 entitled "Chemical Disinfectants and Antiseptics—Quantitative Suspension Test for the Evaluation of Basic Bactericidal Activity of Chemical Disinfectants and Antiseptics—Test Method and Requirements (Phase 1)". Following this procedure Growth-phase bacterial cultures at $1.5\times10^8$ to $5\times10^8$ colony forming units per ml (cfu/ml) were treated with the 10 wt. % soap bar solutions (prepared as described above) at 46° C. In forming the test samples, 8 parts by weight of the 10 wt. % soap bar solution is combined with 1 part by weight of the culture and 1 part by weight of water, i.e., the concentration of the soap bar composition in the test samples is 8 wt. %. After 10, 30, and 60 seconds of exposure, samples were neutralized to arrest the antibacterial activity of the soap solutions. The resulting solutions were serially diluted, plated on solid medium, incubated for 24 hours and surviving cells were enumerated. Bactericidal activity is defined as the log reduction in cfu/ml relative to the bacterial concentration at 0 seconds. Cultures not exposed to any soap or silver solutions serve as no-treatment controls.

The $\log_{10}$ reduction was calculated using the formula:

$$\text{Log}_{10}\text{ Reduction}=\log_{10}\text{ (numbers control)}-\log_{10}\text{ (test sample survivors)}$$

Example 1 relates to tests performed on soap bars as a preferred embodiment.

Example 2 relates to tests performed on liquid soap as a preferred embodiment.

Example 1

Soap bars were prepared according to formulation as indicated in Table 2.

TABLE 2

| Ingredient (wt %) | Comparative Bar 1 | Comparative Bar 2 | Ex Bar 1 |
|---|---|---|---|
| Anhydrous Sodium Soap (85 wt. % tallow soap/ 15 wt. % coconut soap) | 68.0 | 68.0 | 68.0 |
| C10-18 alpha olefin-sulfonate | 1.1 | 1.1 | 1.1 |
| Talc | 6.0 | 6.0 | 6.0 |
| Glycerine | 6.0 | 6.0 | 6.0 |
| Tetrasodium EDTA | 0.04 | 0.04 | 0.04 |
| Silver oxide* | 0.0002 | 0.01 | 0.0002 |
| Luviscol ® VA64 W | — | — | 0.006 |
| Water and other minors | To 100% | To 100% | To 100% |

Note:
*actual Silver content has been indicated in all columns

The antimicrobial (biocidal) activity of the bars so produced was evaluated following the protocol described earlier. Also evaluated were aqueous solutions of silver compound, formulated to a pH comparable to that of the soap solution (i.e., pH 10.7). Biocidal activity results are reported in Table 3.

TABLE 3

| | Log10 value of bacteria remaining at the end of given time | | |
|---|---|---|---|
| Contact time/seconds | Comparative Bar 1 | Comparative Bar 2 | Ex Bar 1 |
| 10 | 7.4 | 7.4 | 7.4 |
| 20 | 7.3 | 7.1 | 6.3 |
| 30 | 7.2 | 6.2 | 5.2 |
| 60 | 6.7 | 5.0 | 3.8 |

As demonstrated by the data of Table 3, Comparative Bars 1 and 2 failed to provide a significant biocidal effect [as shown by $\text{Log}_{10}$ value of bacteria remaining at the end of the contact time] at contact times of 10 to 60 seconds. In contrast, Ex Bar 1, a preferred embodiment, provided significantly lower log value, especially at contact time of from 20 to 60 seconds and despite the fact the Ex Bar 1 composition had very low amount of only 0.0002% actual silver content.

Example 2

Comparative and preferred liquid soap compositions were prepared according to formulations as indicated in Table 4.

TABLE 4

| Ingredients/Wt % | Comparative liquid 2 | Comparative liquid 1 | Ex liquid 1 |
|---|---|---|---|
| Laurie acid soap | 5.8 | 5.8 | 5.8 |
| Myristic acid soap | 6.7 | 6.7 | 6.7 |
| Palmitic acid soap | 2.1 | 2.1 | 2.1 |
| SLES.1EO | 2.1 | 2.1 | 2.1 |
| CAPB | 2.5 | 2.5 | 2.5 |
| EDTA - 4 Na | 0.05 | 0.05 | 0.05 |
| KCl | 3.5 | 3.5 | 3.5 |
| Silver Oxide* | 0.0001 | — | 0.0001 |
| DTPA-Na | 0.0012 | — | 0.0012 |
| PVP | — | — | 0.002 |
| Water and minors | To 100 | To 100 | To 100 |

Note:
*actual Silver content has been indicated in all columns

Antimicrobial efficacy of the comparative and preferred liquids was evaluated following the protocol described earlier with appropriate modification in view of the nature of the product. Results are reported in Table 5.

TABLE 5

| | Log10 value of bacteria remaining at the end of given time | | |
|---|---|---|---|
| Contact time/seconds | Comparative liquid 1 | Comparative liquid 2 | Ex liquid 1 |
| 0 | 7.3 | 7.3 | 7.3 |
| 10 | 6.2 | 6.2 | 6.2 |
| 20 | 5.8 | 5.9 | 5.4 |
| 30 | 5.2 | 5.5 | 4.8 |
| 60 | 4.5 | 4.4 | 3.8 |

As demonstrated by the data of Table 5, Comparative liquid compositions 1 and 2 failed to provide significant biocidal effect at contact times of 10 to 60 seconds, as shown by Log10 value of bacteria remaining at the end of the contact time. In contrast, Ex Liquid 1, another preferred embodiment, provided significantly lower log value in a manner similar to Ex Bar 1, especially at contact time from 20 to 60 seconds and despite the fact the Ex Liquid 1 contained very low amount of only 0.0001% actual silver. This example indicates that the technical effect is evident across product formats.

The invention claimed is:

1. A cleansing composition comprising:

(i) a surfactant;

(ii) 0.00001 to 5 wt % of an oligodynamic metal selected from the group consisting of silver, oxide, silver nitrate, silver acetate, silver sulfate, silver benzoate, silver salicylate, silver carbonate, silver citrate or silver phosphate;

(iii) a chelating agent; and, 0.001 to 2% of a polymer having a group comprising a site having one or more lone pair of electrons, wherein said polymer is selected from the group consisting of polyvinylpyrrolidone, polyvinylacetate, polyvinyl alcohol or a copolymer thereof, and mixtures thereof;

wherein, said surfactant is soap.

2. A composition as claimed in claim 1 comprising 10 wt % to 85 wt % surfactant.

3. A cleansing composition as claimed in claim 1 wherein said chelating agent is ethylene diamine tetraacetic acid (EDTA), ethylene diamine dissuccinate (EDDS), N,N-bis (carboxymethyl) glutamic acid (GLDA), Diethylenetriaminepentaacetic acid (DTPA), Nitrilotriacetic acid (NTA) or Ethanoldiglycinic acid ((EDG).

4. A composition as claimed in claim 1 wherein ratio of said metal to said polymer is in the range of 1:1 to 1:500.

5. A composition as claimed in claim 2 wherein the polyvinylpyrrolidone content in said copolymer is from 10% to 95%.

* * * * *